US008946532B2

(12) United States Patent
Boykin

(10) Patent No.: US 8,946,532 B2
(45) Date of Patent: Feb. 3, 2015

(54) MUSICAL INSTRUMENT PROTECTION

(71) Applicant: Jerald L. Boykin, Baton Rouge, LA (US)

(72) Inventor: Jerald L. Boykin, Baton Rouge, LA (US)

( * ) Notice: Subject to any disclaimer, the term of this patent is extended or adjusted under 35 U.S.C. 154(b) by 0 days.

(21) Appl. No.: 13/900,327

(22) Filed: May 22, 2013

(65) Prior Publication Data

US 2014/0345439 A1 Nov. 27, 2014

(51) Int. Cl.
*G10G 7/00* (2006.01)

(52) U.S. Cl.
CPC ..... *G10G 7/00* (2013.01)
USPC ..... 84/453; 2/48

(58) Field of Classification Search
None
See application file for complete search history.

(56) References Cited

U.S. PATENT DOCUMENTS

| | | | | | |
|---|---|---|---|---|---|
| 999,263 | A | * | 8/1911 | Ruth | 2/48 |
| 1,493,815 | A | * | 5/1924 | Hogan | 2/48 |
| 1,632,873 | A | * | 6/1927 | Bliss | 2/48 |
| D162,235 | S | * | 2/1951 | Schwartzman | D2/864 |
| 3,131,399 | A | * | 5/1964 | Murphy et al. | 2/48 |
| 3,251,258 | A | * | 5/1966 | Parker | 84/453 |
| 3,309,954 | A | * | 3/1967 | Phillips et al. | 84/453 |
| 3,877,501 | A | * | 4/1975 | Toth | 150/162 |
| 4,000,678 | A | * | 1/1977 | Messina | 84/453 |
| 4,037,509 | A | * | 7/1977 | Slomovits | 84/422.3 |
| 4,121,494 | A | * | 10/1978 | Reno et al. | 84/453 |
| 4,177,847 | A | * | 12/1979 | Spindler | 150/162 |
| D278,442 | S | * | 4/1985 | Whomsley | D17/20 |
| D305,827 | S | * | 2/1990 | Flowers | D2/864 |
| D320,405 | S | * | 10/1991 | Wyant | D17/20 |
| 5,052,055 | A | * | 10/1991 | Mysliwiec | 2/48 |
| D322,717 | S | * | 12/1991 | Wyant | D3/204 |
| 5,103,709 | A | * | 4/1992 | Foss, Jr. | 84/327 |
| 5,829,056 | A | * | 11/1998 | Hubert | 2/48 |
| 6,054,642 | A | * | 4/2000 | Brooks | 84/267 |
| 6,143,964 | A | * | 11/2000 | Chen | 84/280 |
| 6,410,834 | B1 | * | 6/2002 | Hearfield | 84/453 |
| 6,441,288 | B1 | * | 8/2002 | Lin | 84/453 |
| 6,472,590 | B1 | * | 10/2002 | Kulik | 84/453 |
| 6,723,906 | B2 | * | 4/2004 | Bourgoin | 84/411 R |
| 6,774,295 | B2 | * | 8/2004 | Tuite | 84/453 |
| D555,880 | S | * | 11/2007 | Lowe | D2/864 |
| 7,291,778 | B2 | * | 11/2007 | Larry | 84/453 |
| 7,671,264 | B1 | * | 3/2010 | Heda | 84/453 |
| 7,956,270 | B1 | * | 6/2011 | Burmeister et al. | 84/453 |
| 8,476,519 | B2 | * | 7/2013 | Liotta | 84/615 |
| 8,642,873 | B2 | * | 2/2014 | Liotta | 84/615 |
| 2004/0011186 | A1 | * | 1/2004 | Hester, III | 84/453 |
| 2011/0197333 | A1 | * | 8/2011 | Liotta | 2/90 |
| 2011/0197739 | A1 | * | 8/2011 | Pearce et al. | 84/453 |
| 2011/0203953 | A1 | * | 8/2011 | Fowler, II | 206/314 |
| 2013/0312586 | A1 | * | 11/2013 | Brunnemer | 84/453 |
| 2014/0109749 | A1 | * | 4/2014 | Schulze | 84/453 |
| 2014/0230117 | A1 | * | 8/2014 | Schnitzlein et al. | 2/48 |

* cited by examiner

*Primary Examiner* — Robert W Horn
(74) *Attorney, Agent, or Firm* — James C. Carver

(57) ABSTRACT

A protective apron that protects a soft-metal musical instrument, where in the apron may have one, two, or more layers. The outer layer prevents the soft-metal musical instrument from being scratched, dented, or tarnished while said instrument is being played. An inner layer may be used to inhibit moisture from the player from reaching the soft-metal musical instrument.

14 Claims, 1 Drawing Sheet

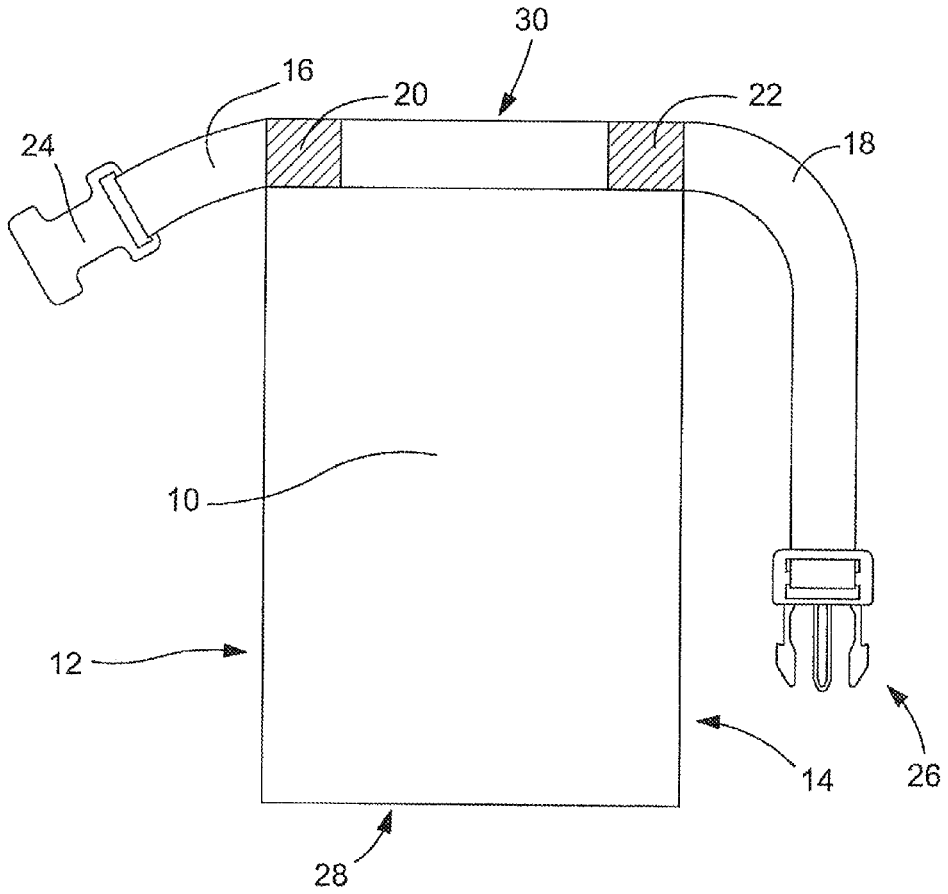
30
16
20
22
24
18
10
12
14
26
28

MUSICAL INSTRUMENT PROTECTION

This invention pertains to a new and distinct method for protecting valuable musical instruments from damage while the musical instruments are being played.

BACKGROUND OF THE INVENTION

Metallic musical instruments, comprising trumpets, trombones, saxophones, tubas, euphoniums, baritone horns, comets, flugelhorns, and bugles, are typically constructed of soft-metal alloys, comprising brass (copper and zinc), bronze (copper and tin), and nickel-silver (copper, zinc, and nickel).

When a musical instrument constructed of a soft-metal alloy is held against a player's body while the player is playing of the musical instrument, exterior parts of the soft-metal alloy musical instrument may be damaged from contact with perspiration, rough clothing, belts, jewelry, or other personal items on the players body or clothing or in the players clothing.

For example, when soft-metal alloy musical instruments such as saxophones or tubas rest against a player's leg or other parts of the player while being played, external parts of the musical instrument may be tarnished by perspiration, or scratched or dented by contact with rough clothing, belts, jewelry, or other personal items of the player.

Musical instruments that are tarnished, scratched, dented, or otherwise damaged, may lose significant economic value.

The invention claimed herein is designed to prevent or diminish musical instruments constructed of soft metal from damage, comprising tarnishing, scratching, and denting.

While numerous devices are known in the art that provide protection for soft-metal alloy musical instruments while being transported from one place to another or while being stored, typically there is no method for protecting soft-metal musical instruments while the instrument is being played.

Devices and methods for protecting string instruments, which are typically constructed from wood, while the string instrument is being played have been disclosed, but the devises and methods designed for string instruments are not applicable to soft-metal alloy instruments. Inventor has found no protective device designed to protect musical instruments constructed of soft-metal alloys such as saxophones, while the musical instrument is being played.

We have found no patent, patent application, nor other literature describing a method or a devise for protecting soft-metal musical instruments while the soft-metal musical instrument is being played.

BRIEF SUMMARY OF INVENTION

We disclose a new method for protecting valuable musical instruments. This novel method comprises using a protective apron worn over clothing placed between the musical instrument and player of the musical instrument. The protective apron prevents the musical instrument from being damaged by the player or the player's clothing while the instrument is being played.

Protective aprons may be constructed of material that is scratch resistant and that provides a moisture barrier between a player and a soft-metal alloy musical instrument.

The protective apron is worn by the player of the soft-metal musical instrument in such a manner that the apron covers the player's leg or body at such places that would otherwise be in contact with the soft-metal musical instrument.

BRIEF DESCRIPTION OF DRAWINGS

FIG. 1 depicts the protective apron.

DETAILED DESCRIPTION OF THE INVENTION

Musical Instruments that are primarily constructed of a soft metal, for example brass, are subject to damage to the exterior of the musical instrument when the musical instrument comes in contact with corrosive substances or rough or abrading items.

Perspiration from a person may contain a variety of soluble chemicals comprising sodium chloride, other mineral salts, sulfur compounds, and organic compounds. The composition of perspiration will vary from person to person. Perspiration, comprising water solutions comprising sodium chloride, other mineral salts, sulfur compounds, and organic compounds, may cause metal, for example brass, to become discolored or corroded.

Metal used in construction of certain musical instruments, comprising trumpets, trombones, saxophones, tubas, and French horns, is often a soft metal, for example brass, that is easily scratched, dented, or otherwise damaged. Item comprising belts, belt buckles, attachments to belts, buttons, rough or dirty clothing, and jewelry if allowed to rub against or otherwise impact exteriors of musical instruments constructed of a soft metal, for example brass, will damage the exteriors.

Protective aprons revealed in this invention, and as shown in FIG. 1, are constructed of materials that are scratch resistant and that provide a moisture barrier between a player and a soft-metal musical instrument. Protective aprons may be single layer units or may be multilayers units.

Protective aprons may be constructed of material that is scratch resistant and that provides a moisture barrier between a player and a soft-metal alloy musical instrument. Material used for protective aprons comprise silk, linen, Velvet®, foam, polyester, polyamide, velour, microfiber, suede, felt, leather, and cotton flannel. The apron may be constructed in layers so that material against the player's leg or body is different from material against a soft-metal musical instrument.

The protective apron is worn by the player of the soft-metal musical instrument in such a manner that the apron covers the player's leg or body at such places that would otherwise be in contact with the soft-metal musical instrument.

EXAMPLE 1

Tenor saxophones were protected while the instrument was being played by using a single layer protective apron, 10, constructed of felt which has a top edge, a left edge, a right edge, and a bottom edge. As shown in FIG. 1, the top edge of the apron, 26, is between 1 ft. and 2 ft. from the bottom edge, 28, and the left edge, 12, is between 0.5 ft. and 1.25 ft. from the right edge, 14.

Affixed to the apron, 10, on the left edge, 12, is a first elastic piece, 16, that is about 1 in. in width. The first elastic piece, 16, is attached to the top left edge, 20, of the apron, 10, at a distance between 0.10 and 0.50 in. from the top edge, 30, of the apron, 10. Affixed to the apron, 10, on the right edge, 14, is a second elastic piece, 18, which is about 1 in. in width. The second elastic piece, 18, is attached to the top right edge, 22, of the apron, 10, at a distance between 0.10 and 0.50 in. from the top edge, 30, of the apron, 10. The first elastic piece, 16, which is about 5 in. to 10 in. long, is connected by a first connecting device, 24, located on the distal end of the first elastic piece, 26, to the second elastic piece, 18, which is between 20 in. and 30 in. long, by a second connecting device, 26, located on the distal end of the second elastic piece, 18.

The single layer protective apron was held in place against the body of a player of an instrument by connecting the first connecting device, 24, located at the distal end of the first elastic piece, 16, to the second connecting piece, 26, located at the distal end of the second elastic piece, 18. The first elastic piece, 16, and the second elastic piece, 18, may be connected to each other using buckling devices, 24 and 26, attached to the distal ends of the first, 16, and second, 18, elastic pieces. Other means of connecting the elastic pieces comprising snaps, buttons, and self-adhering materials, such as Velcro®, may be used. The first, 16, or the second, 18, elastic piece may be adjustable in order to allow the player to shorten the first, 16, or second, 18, elastic piece in order to hold a protective apron tightly against the body of the player of an instrument. Other saxophones, comprising alto, baritone and bass saxophones may be protected in using this method, although the dimensions of the single layer protective apron, 10, may be altered to fit the size of the instrument.

EXAMPLE 2

A two layer protective apron may be constructed of an outer layer comprising a soft non-abrasive material such as silk, linen, Velvet®, foam, polyester, polyamide, velour, microfiber, suede, felt, leather, or cotton flannel, and an inner layer comprising a water resistant material such as rubber, polyvinylchloride ("PVC"), polyester, nylon, or polyurethane. The dimensions of the first outer layer and the second inner layer are approximately the same. The first outer layer may be attached by sowing, gluing, clipping, or otherwise merging the first outer layer material to the second inner layer material along the top, left, right and bottom edges of the two layers.

A two-layer protective apron (not shown) has a top edge, a left edge, a right edge, and a bottom edge, similar to the apron, 10, shown in FIG. 1. The length of a two-layer protective apron is between 1 ft. and 2 ft. The distance between the right edge and the left edge is between 0.5 ft. and 1.25 ft. Affixed to the apron at the top left edge is a first elastic piece that is about 1 in. in width. The top of the first elastic piece is attached to the left edge of the apron at a distance between 0.10 and 0.50 in. from the top edge of the apron. Affixed to the apron on the right edge is a second elastic piece that is about 1 in. in width. The top of the second elastic piece is attached to the right edge of the apron at a distance between 0.10 and 0.50 in. from the top edge of the apron. The first elastic piece, which is about 5 in. to 10 in. long, is connected to the second elastic piece, which is between 20 in. and 30 in. long. When the first elastic piece and the second elastic piece are connected, the protective apron is held in place against the body of a player of an instrument. The first elastic piece and the second elastic piece may be attached to each other at the ends distal to the attachment of the first and second elastic pieces to the protective apron using buckling devices attached to the distal ends of the first and second elastic pieces. Other means of connecting the elastic pieces comprising snaps, buttons, and self-adhering materials, such as Velcro®, may be used. The first or the second elastic piece may be adjustable in order to hold the protective apron tightly against the body of the player of an instrument.

The invention claimed is:

1. A protective apron worn by a player of a musical instrument that protects the musical instrument from damage while the musical instrument is being played, a. wherein the protective apron is constructed of a non-abrasive material comprising silk, linen, Velvet®, foam, polyester, polyimide, velour, microfiber, suede, felt, leather, and cotton flannel, and b. wherein the protective apron covers only a portion of clothing worn by a person, or a portion of a person's body, while the person is playing a musical instrument, and c. wherein the only portion of the clothing, or the person's body, being covered is limited to that part of the player's body, or clothing covering the portion of the player's body, that may come into contact with a musical instrument while the musical instrument is being played by the player comprising the player's abdomen, waist, and upper legs.

2. A protective apron as in claim 1 wherein the musical instrument is protected from being damaged by rough or protruding attachments to the clothing comprising tie pins, necklaces, buckles, buttons, belts, and snaps, or from perspiration from the player's body.

3. A protective apron as in claim 1 wherein the protective apron is sized to cover only the part of the player's body and clothing where the musical instrument normally rests against the player's body while being played.

4. A protective apron as in claim 3 wherein the protective apron is between 1 foot and 2 foot from its top edge to its bottom edge and the protective apron is between 0.5 foot and 1.25 foot from its right edge to its left edge.

5. A protective apron as in claim 1 wherein the device is held in position between the player of the musical instrument and the musical instrument by a first elastic piece attached to the left edge of the protective apron and a second elastic piece attached to the right edge of the protective apron, with the first elastic piece and the second elastic piece attaching together at the player's back, a) wherein the first elastic piece is attached to the second elastic piece by a coupling device comprising buckles, snaps, buttons, and self-adhering materials, such as Velcro®, and b) wherein the first and second elastic pieces are approximately 1 inch wide, and c) wherein the first elastic piece is between 5 inches and 10 inches long, and the second elastic piece is between 20 inches and 30 inches long, and d) wherein the first elastic piece is attached to the left edge of the protective apron at a distance between 0.10 and 0.50 inches from the top edge of the protective apron, and e) wherein the second elastic piece is attached to the right edge of the protective apron at a distance between 0.10 and 0.50 inches from the top edge of the protective apron.

6. A protective apron as in claim 2 designed to protect musical instruments comprising saxophones, tubas, euphoniums, baritone horns, and flugelhorns.

7. A protective apron as in claim 2 designed to protect saxophones.

8. A protective apron worn by a player of a musical instrument that protects the musical instrument from damage while the musical instrument is being played, a. wherein the protective apron is constructed of at least two layers of material wherein the outer layer constructed of a non-abrasive material comprising silk, linen, Velvet®, foam, polyester, polyamide, velour, microfiber, suede, felt, leather, and cotton flannel, and the inner layer is constructed of a moisture-resistant material comprising rubber, polyvinylchloride ("PVC"), polyester, nylon, and polyurethane, providing a moisture barrier between the player of the musical instrument and the musical instrument itself, and b. wherein the protective apron covers only a portion of clothing worn by a person, or a portion of a person's body, while the person is playing a musical instrument, and c. wherein the only portion of the clothing, or the person's body, being covered is limited to that part of the player's body, or clothing covering the portion of the player's body, that may come into contact with a musical instrument while the musical instrument is being played by the player comprising the player's abdomen, waist, and upper legs.

9. A protective apron as in claim 8 wherein the musical instrument is protected from being damaged by rough or protruding attachments to the clothing comprising tie pins, necklaces, buckles, buttons, belts, and snaps, or from perspiration from the player's body.

10. A protective apron as in claim 8 wherein the protective apron is sized to cover only the part of the player's body and clothing where the musical instrument normally rests against the player's body while being played.

11. A protective apron as in claim 10 wherein the protective apron is between 1 foot and 2 foot from its top edge to its bottom edge and the protective apron is between 0.5 foot and 1.25 foot from its right edge to its left edge.

12. A protective apron as in claim 8 wherein the device is held in position between the player of the musical instrument and the musical instrument by a first elastic piece attached to the left edge of the protective apron and a second elastic piece attached to the right edge of the protective apron, with the first elastic piece and the second elastic piece attaching together at the player's back, a) wherein the first elastic piece is attached to the second elastic piece by a coupling device comprising buckles, snaps, buttons, and self-adhering materials, such as Velcro®, and b) wherein the first and second elastic pieces are approximately 1 inch wide, and c) wherein the first elastic piece is between 5 inches and 10 inches long, and the second elastic piece is between 20 inches and 30 inches long, and d) wherein the first elastic piece is attached to the left edge of the protective apron at a distance between 0.10 and 0.50 inches from the top edge of the protective apron, and e) wherein the second elastic piece is attached to the right edge of the protective apron at a distance between 0.10 and 0.50 inches from the top edge of the protective apron.

13. A protective apron as in claim 9 designed to protect musical instruments comprising saxophones, tubas, euphoniums, baritone horns, and flugelhorns.

14. A protective apron as in claim 9 designed to protect saxophones.

* * * * *